US010906083B1

(12) United States Patent
Dudt et al.

(10) Patent No.: US 10,906,083 B1
(45) Date of Patent: Feb. 2, 2021

(54) APPARATUS AND METHOD FOR OUTER SURFACE ENHANCEMENT AND COMPACTION OF A SPHERICAL STRUCTURE USING GLASS FAILURE GENERATED PULSE

(71) Applicants: Philip Dudt, North Bethesda, MD (US); Roshdy George Barsoum, McLean, VA (US)

(72) Inventors: Philip Dudt, North Bethesda, MD (US); Roshdy George Barsoum, McLean, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 270 days.

(21) Appl. No.: 15/719,951

(22) Filed: Sep. 29, 2017

(51) Int. Cl.
*B21D 31/00* (2006.01)
*C21D 7/06* (2006.01)

(52) U.S. Cl.
CPC ..... *B21D 31/00* (2013.01); *C21D 7/06* (2013.01)

(58) Field of Classification Search
CPC ..... B21D 31/00; B21D 26/06; B21D 26/02; C21D 7/00; C21D 7/06; C22F 1/00; C22F 3/00; B01J 3/08
USPC ..... 148/515, 558
See application file for complete search history.

(56) References Cited

U.S. PATENT DOCUMENTS

| | | | | | |
|---|---|---|---|---|---|
| 2,798,832 | A * | 7/1957 | Harvey | C21D 1/04 | 148/558 |
| 4,552,742 | A * | 11/1985 | Mayer | B01J 3/08 | 102/201 |
| 4,874,596 | A * | 10/1989 | Lemelson | B01J 3/08 | 423/446 |
| 5,950,469 | A * | 9/1999 | Tsuro | C21D 7/04 | 29/898.069 |
| 7,861,573 | B1 * | 1/2011 | Tenaglia | G01N 3/60 | 73/12.08 |
| 2016/0237521 | A1 * | 8/2016 | Zhang | C21D 7/06 | |

* cited by examiner

*Primary Examiner* — Teresa M Ekiert
(74) *Attorney, Agent, or Firm* — Dave Ghatt

(57) ABSTRACT

An apparatus and method for treatment of articles, using glass failure generated pulses. The apparatus and method is directed towards the hardening and compaction of a spherical article surrounded by a glass orb in a confined arrangement. The apparatus includes a striker having first and second opposing strikers for striking the glass orb from different sides of the confinement arrangement, to create an explosive reaction that pressure-treats the spherical article, thereby causing the hardening and compaction.

12 Claims, 4 Drawing Sheets

APPARATUS AND METHOD FOR OUTER SURFACE ENHANCEMENT AND COMPACTION OF A SPHERICAL STRUCTURE USING GLASS FAILURE GENERATED PULSE

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

CROSS-REFERENCE TO RELATED APPLICATIONS

This application is related to the pending U.S. Non Provisional patent application, application Ser. No. 15/719,868 filed concurrently with the instant application, herein incorporated by reference, entitled "Apparatus and Method for Outer Surface Enhancement and Compaction of a Cylindrical Structure Using Glass Failure Generated Pulse," by inventors Philip Dudt and Roshdy George Barsoum.

This application is related to the pending U.S. Non Provisional patent application, application Ser. No. 15/720,033 filed concurrently with the instant application, herein incorporated by reference, entitled "Apparatus and Method for Outer Surface Enhancement and Compaction of an Object Using Glass Failure Generated Pulses in an Explosive Arrangement," by inventors Philip Dudt and Roshdy George Barsoum.

This application is related to the pending U.S. Non Provisional patent application, application Ser. No. 15/720,111 filed concurrently with the instant application, herein incorporated by reference, entitled "Apparatus and Method for Inner Cylindrical Surface Enhancement and Compaction of a Structure Using Glass Failure Generated Pulse," by inventors Philip Dudt and Roshdy George Barsoum.

TECHNICAL HELD

The following description relates generally to an apparatus and method for treating articles, using glass failure generated pulses. In particular, the apparatus and method is directed towards the hardening and compacting of a spherical component, surrounding by a glass sleeve in a confined arrangement, the apparatus also including a striker assembly for striking the glass sleeve to generate a desired pulse.

BACKGROUND

There is always a need for stronger and harder alloys to improve the performance and lifetime of structures and platforms. Engineers are looking for high strength materials to improve performance and safety, while maintaining low weight requirements. Strength limitations directly affect how industrial parts are used. Engineers are actively looking for alloys with material properties sufficient for manufacturing and use, while providing fatigue, fracture, and corrosion resistance, while maintaining or improving mechanical properties.

Fatigue and fracture strengths of machinery parts, nonmoving parts such as gun barrels, and weldments can be improved by generating high compressive strengths on their surface. The benefit is that the compressive stresses must be overcome before tension strains can be produced leading to crack initiation and extension. A number of known methods are used industrially for enhancing the surface strength profile. This includes the application of plastic stresses imparted using large rolling machines, carbonizing, shot peening, and explosive detonation.

Many industrial parts, which cannot be otherwise produced by casting, rolling or forging can be fabricated using powder metallurgy techniques. The parts, such as gears, shafts, brackets, bearings, and ball joints etc., are compacted and the powder with matrix portions are bonded together using hot isostatic pressing (HIP), along with follow-on heat application. Dynamically compressing parts under high dynamic loading is a useful process.

Another known technique for treating the surfaces of industrial parts to improve fatigue and fracture properties is shot peening. This technique enables a rise in the hardness of a surface layer of a work piece and introduction of compressive residual stress into the surface layer. This technique is widely used in the industrial fields of automobiles, aircrafts, etc.

Yet another known technique is laser shock hardening. This involves irradiating the surface of a solid material, such as a metal or a ceramic, with pulsed laser beam through a liquid to adjust surface of internal characteristics of the mater ial, such as structure, hardness and residual stress.

Generally speaking, laser shock hardening has a higher effect than shot peening and in addition has various excellent advantages that shot peening does not have, such as capability of contactless operation, no involvement of reaction force and capability of precise control of laser irradiation conditions and laser irradiation sites. Even with all these known techniques, it is still desired to have a method and an apparatus to improve the ability to strengthen and to make more compact, the surface of industrial parts. Such a method may also be used to supplement other forms of surface hardening, such as carburizing, nitriding and cyaniding.

SUMMARY

In one aspect, the invention is a system for hardening and compacting a spherical structure. In this aspect, the system includes a confinement assembly. The confinement assembly includes a spherical structure, a glass orb surrounding and contacting the spherical structure, and a rigid outer shell encasing the glass orb and the spherical structure therewithin. In this aspect, the spherical structure, the glass orb, and the rigid outer shell are positioned in a concentric relation with respect to each other. The system also includes a striker assembly having a first striker, and a second striker. Each of the first striker and the second striker is positioned to strike the confinement assembly from opposite sides of the confinement assembly along an axis that extends through a central region of the confinement assembly, so that when launched, the first and second striker shatter the glass of the glass orb to create an explosive volume expansion of the glass. According to the invention, due to the confinement assembly, the explosive volume expansion results in compressive forces being applied to the surface of the spherical structure, thereby hardening and compacting the spherical structure.

In another aspect, the invention is a method of hardening and compacting a spherical structure. The method includes, providing a confinement assembly. The confinement assembly includes a spherical structure, a glass orb surrounding and contacting the spherical structure, and a rigid outer shell encasing the glass orb and the spherical structure therewithin. In this aspect, the spherical structure, the glass orb, and the rigid outer shell are positioned in a concentric relation with respect to each other. According to the invention, the method also includes providing a striker assembly having a first striker, and a second striker. Each of the first striker and the second striker is positioned to strike the confinement assembly from opposite sides of the confinement assembly along an axis that extends through a central region of the confinement assembly. The method also includes directing each of the first striker and the second striker to strike the confinement assembly from opposite sides of the confinement assembly along an axis that extends through a central region of the confinement assembly. Thus, according to the method, the first and second striker shatter the glass of the glass orb to create an explosive volume expansion of the glass, which due to the confinement assembly, results in compressive forces being applied to the surface of the spherical structure, thereby hardening and compacting the spherical structure.

BRIEF DESCRIPTION OF THE DRAWINGS

Other features will be apparent from the description, the drawings, and the claims.

DETAILED DESCRIPTION

Figures 1A, 1B:
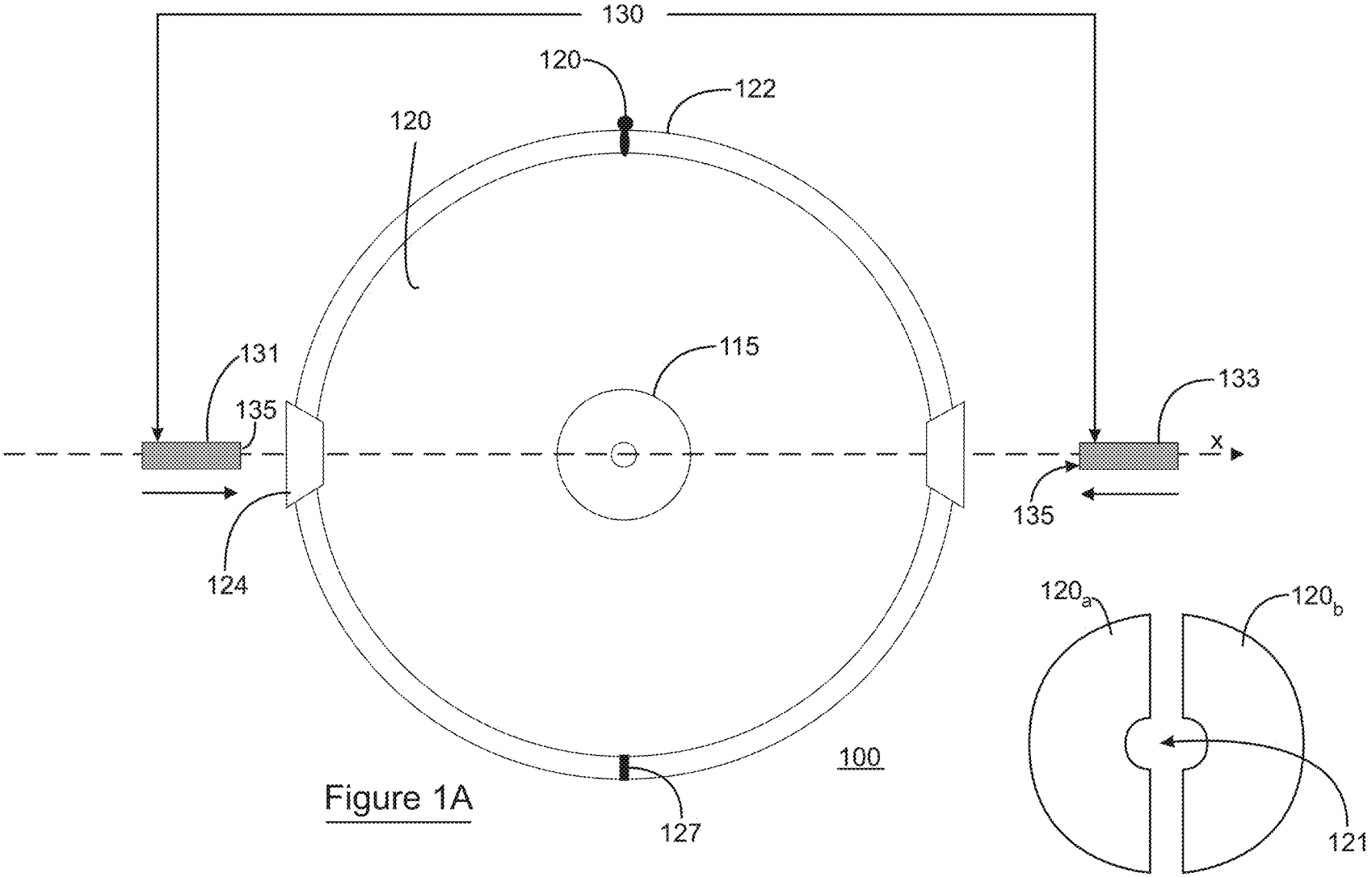
FIG. 1A is an exemplary sectional view of a system for hardening and compacting a spherical structure, according to an embodiment of the invention.
FIG. 1B is an exemplary illustration of a solid glass orb, according to an embodiment of the invention.

FIG. 1A is an exemplary sectional view of a system 100 hardening and compacting a spherical structure, according to an embodiment of the invention. As shown, the system includes a confinement assembly 110 and a striker assembly 130. The confinement assembly includes a spherical structure 115. The spherical structure 115 is to be hardened and compacted, as outlined below. The spherical structure 115 may be made from metallic materials such as 1015 steel, 4140 steel, and the like. The spherical structure 115 may be a solid sphere and used as an industrial part, such as a ball joint or a ball bearing for a mechanical device, or for the tip of a projectile, for example, and thus may be sized in accordance with the application. The spherical structure 115 could vary in size, for example having a diameter of about 0.5 inches to about 3.0 inches in diameter.

The confinement assembly 110 also includes a glass orb 120 surrounding and contacting the spherical structure 115. According to one embodiment of the invention, the glass orb 120 is solid glass. FIG. 1B is an exemplary illustration of a solid glass orb 120 according to an embodiment of the invention. As shown, the solid glass orb 120 may include two half orbs 120*a* and 120*b*, which may be separated and put together to allow for the positioning of the spherical structure 115 within a spherical gap 121 created by the half orbs 120*a* and 120*b*. It should be understood that although FIG. 1B shows the glass orb 120 being made from two half-orbs 120*a* and 120*b*, it is within the scope of the invention to for the orb 120 to be made up of more than two separate orb segments, such as three or four or five or six orb segments, for example.

Returning to FIG. 1A, according to another embodiment of the invention, the glass orb 120 is made up of densely packed glass particles. According to this embodiment, the spherical structure 115 may be packed and surrounded by the glass panicles. According to another embodiment of the invention, liquid glass may be poured to surround the spherical structure, and then allowed to harden. The glass for embodiments of both solid glass and glass particles may be for example, any known type of glass such as silica glass, fused silica, fluoride glass, alumino silicate glass, phosphate glass, borosilicate glass, or flint glass.

FIG. 1A also shows the system 100 having a rigid outer shell 122, which also has a spherical shape. The outer shell encases both the glass orb 120 and the spherical structure 115. As shown hi FIG. 1A, the rigid outer shell 122 may be openable into two semi-spheres. According to one embodiment, the rigid outer shell 122 is openable into the two semi spheres via a hinge 127, and closable into the single structure by a latch 129. The structure may also include mating interconnecting grooves on opposing contacting surfaces of the respective semi-spheres. As shown, the rigid outer shell may optionally include openings 124, which as outlined below, is for receiving the protrusion portions of the striker assembly 130. The rigid outer shell 122 may be a thick containment vessel, such as a gun barrel, for example. As shown, the spherical structure 115, the glass orb 120, and the rigid outer shell 122 are positioned in a concentric relation with respect to each other.

FIG. 1A also shows the striker assembly having a first striker 131 and a second striker 133, both having protrusion portions with rectangular profiles/sections with a flat head 135 for impacting the glass. As shown, the first striker 131 and the second striker 133 are positioned to strike the confinement assembly 110 from opposite sides of the confinement assembly 110. As shown, the first striker 131 and the second striker 131 are positioned along axis X that extends through the central region of the confinement assembly 110. As outlined below, this arrangement of strikers 131 and 133 allows the strikers to shatter the glass and produce waves in opposite directions within the confinement assembly, focusing the failure waves to form a failure wave interference system within the confinement assembly 110. The glass undergoes an explosive volume expansion. Partly due to the confinement of the glass in the confinement assembly 110, compressive forces act on the surface of the spherical structure 115, thereby hardening the surface of the spherical structure 115. In embodiments that include shell openings 124, the openings 124 are also positioned along the axis X, and the strikers 131 and 133, strike the glass orb 120, through the openings 124.

Figure 2A:
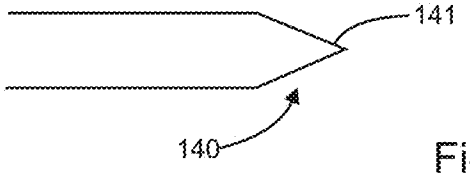
FIGS. 2A 2C are exemplary illustrations of striker assemblies, according to embodiments of the invention.
Figure 2B:
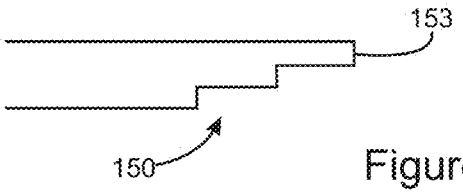
Figure 2C:
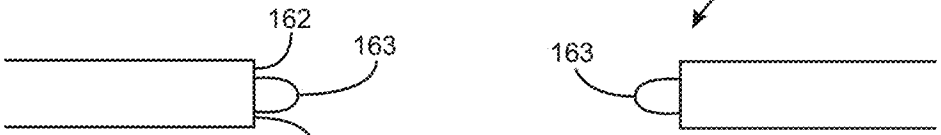

FIGS. 2A 2C are exemplary illustrations of strikers assemblies 130, according to embodiments of the invention. It should be noted that the arrangements shown in each of FIGS. 2A-2C show protrusion portions for striker assembly 130, with each protrusion portion arrangement, applicable to both the strikers 131 and 133, and applicable as alternatives to the rectangular profile shown in FIG. 1A. FIG. 2A shows an embodiment, in which the protrusion portion 140 of the strikers (131 and 133) has a triangular profile, having a pointed tip 141 for impacting the glass. FIG. 2B shows a protrusion portion 150 having a 3-step profile, with steps 151, 152, and 153. As outlined below, in operation, the flat step portion 153 makes initial contact with the glass to provide a continuous force field of failure waves, as compared to the triangular protrusion portion 140, FIG. 2C shows the striker assembly 130 having a protrusion portion 160 having a 2-step profile, with steps 161, 162, and a slightly curved top contact portion 163. In operation, the slightly curved top contact portion 163 makes initial contact with the glass. As outlined below, this design provides a more continuous force field of failure waves.

Figure 3:
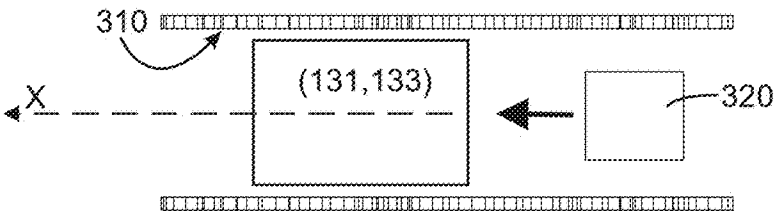
FIG. 3 is a simplified exemplary illustration of a launching mechanism for launching strikers of the striker assembly 130, according to an embodiment of the invention.

The striker assembly 130 could be launched by a known mechanism, such as a gas gun, contact explosive, or by a drop weight device. FIG. 3 is a simplified exemplary illustration of a launching mechanism for launching the strikers 131 and 133 of the striker assembly 130, according to an embodiment of the invention. Each striker may be launched by a launching mechanism as shown. The launching mechanisms include a cylindrical passage 310 that complements the shape of the respective striker 131 or 133, each passage 310 aligned to direct the respective strikers 131 and 133 to strike the glass of the confinement assembly 110 from opposite sides of the confinement assembly 110 along the axis X that extends through the central region of the confinement assembly 110.

Each launching mechanism includes a device, charge, explosive, or the like for launching the respective strikers 131 and 133. This mechanism is shown schematically as element 320, and may be a projectile component that is a part of a known gun, such as a gas gun or a rail gun, which impacts the striker assembly 130. Alternatively, element 320 may represent an explosive charge. Explosive charges of pentotite, C-4, or other known explosives are applicable, with charge sizes on the order of about 0.0625 to about 0.5 lbs. are applicable. When set in motion by these known firing components, such by impact from projectile component 320 or by direct gas or rail gun or explosive, the striker assembly 130 may be set in motion at speeds of about 500 feet per second to about 20,000 feet per second.

In operation, the strikers 131 and 133 of the assembly 130, moving at a high velocity in opposite directions, along the X-axis, impinge on the glass orb 120, with the protrusion portions outlined above, making contact with the glass. The strikers 131 and 133 each contact the glass while moving at speeds between 500 feet per second to about 20,000 feet per second. This generates explosive forces for several reasons. First, due to the phenomenon called "Reynolds Dilatancy" in which multiple cracks force the volume occupied to increase as the cracks rupture and expand the molecular structure. The glass experiences this Reynolds Dilatancy when impacted by the high velocity strikers 131 and 133. The pressure created by the ruptured glass within the confined area of the confinement assembly 110, serves to pressurize the spherical structure 115, thereby hardening and compacting the spherical structure 115. Spherical structures that are treated as outlined above could have different sizes. For example, the spherical structure 115 may have a diameter of about 0.5 inches to about 3.0 inches in diameter.

Figure 4:
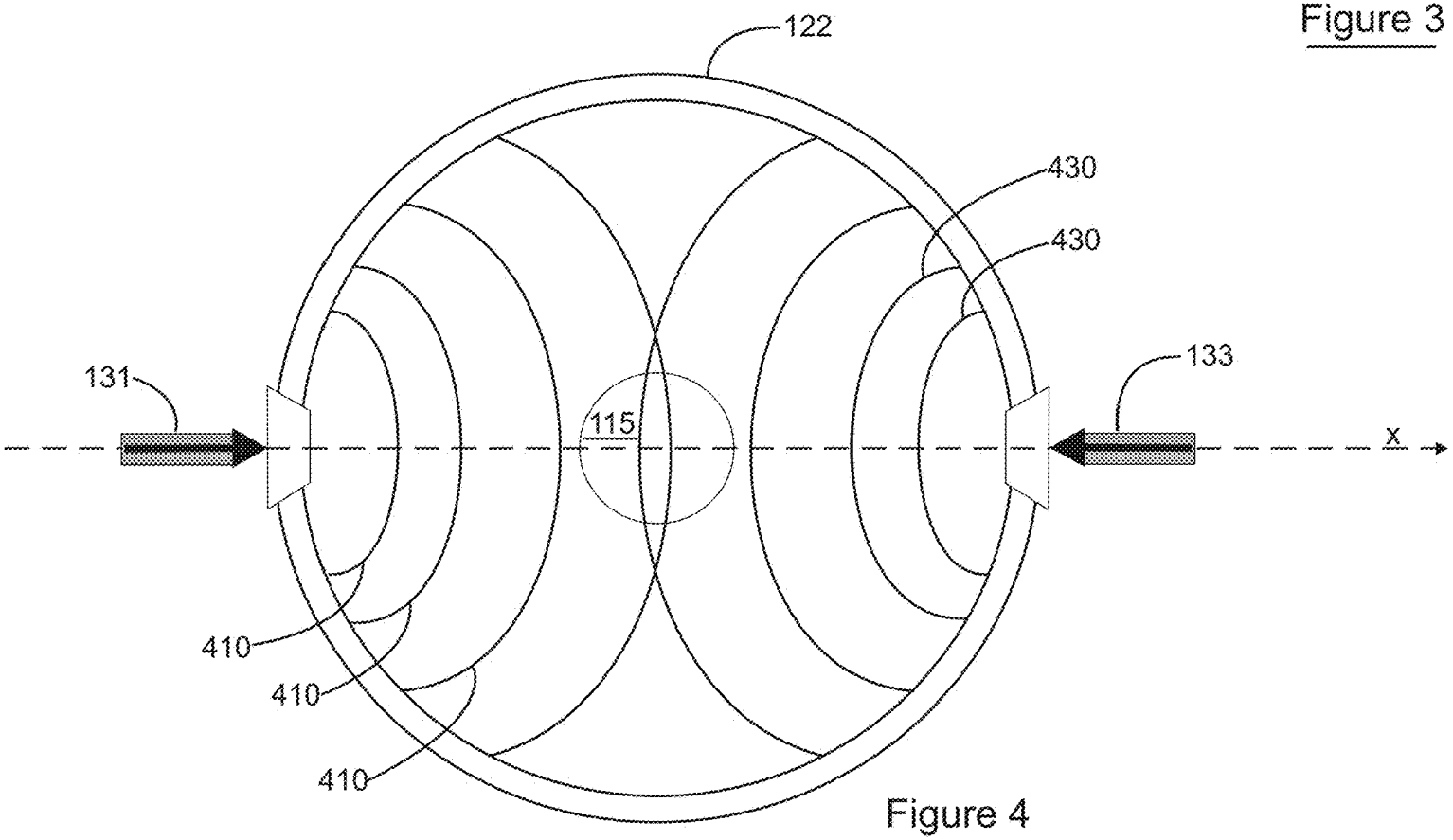
FIG. 4 is an exemplary explanatory illustration of a system for hardening and compacting a spherical structure, according to an embodiment of the invention.

Additionally, the impact by the high velocity strikers 131 and 133 on the glass causes failure waves, FIG. 4 is an exemplary explanatory illustration of a system 100 for hardening and compacting a spherical structure 115, according to an embodiment of the invention. FIG. 4 shows the failure waves 410 and 430, created by strikers 131 and 133 respectively. The failure waves 410 and 430 are waves that propagate so the glass material is intact ahead of the wave and comminuted behind the wave.

It should also be understood that the failure waves propagated from the opposite sides of the confinement assembly intersect each other. Thus failure waves 410 propagated by the striker 131, intersect with failure waves 430 propagated by striker 133. Additionally, because of the rigid nature of the outer shell 122, failure waves are also reflected back and forth off the shell 122. These waves traveling in opposite directions, and intersecting each other results in the formation of a failure wave interference system that enhances comminution and the degree of explosiveness of the failure within the confined area of the confinement assembly 110. In embodiments in which the glass orb 120 comprises glass particles, it is preferred that the glass particles are more granulated, as opposed to fine powdered, which also helps to create more substantial failure waves. This results in the hardening and compacting of the spherical structure 115.

It should be noted that embodiments that include the stepped protrusion portions 150 and 160, more continuous or additional waves are created, which can provide a control on the pressurization forces, and timing of the waves. In essence, there is more control of the level and timing of the explosive waves to control the duration features of the pulse. The level of applied impulse (pressure over time) can affect the polymorphic transitions in the glass.

The impact by the high velocity strikers 131 and 133 of the assembly 130 on the glass may involve a third phenomenon which occurs when the high velocity impact of the striker assembly 130 on the glass is so forceful that coesite, stishovite, or seifertite, which are denser forms of silicate, are created. Stishovite has a density of about 4.6 gm/cc as compared to 2.6 gm/cc. It is understood that when the stishovite-type polymorphs rupture they may convert to an amorphous state. It is generally understood that polymorphs that initially form under the high pressure in the glass have smaller volume contents. Then they appear to revert to the larger volume condition, this volume change helping to create the bulking. This rebound effect increases the applied pressure via the volume expansion. It should also be understood that in response to the impact of the high velocity strikers, the coesite, stishovite, and seifertite may be created simultaneously, but at different locations. The highest pressures producing stishovite and seifertite. Near the boundaries at lower pressures, coesite could be produced.

On average, due to the different phenomenon outlined above, i.e., on account of Reynolds Dilatancy, the formation of intersecting failure waves, and the creation of coesite or stishovite or seifertite, the volume expansion could be up to 40 percent or even greater. Specifically regarding stishovite, expansions of around 77 percent at high pressures may occur. It should be noted that only a limited amount of the material would likely change to this polymorph. Again, as stated above, due to the confined area of the confinement assembly 110, the explosive volume expansion created by the striker assembly 130 impacting the glass creates intense pressurization forces on the spherical structure 115. This results in the hardening and compacting of the shaft 115, with higher and more intense pressures created with the formation of coesite, stishovite, and seifertite, producing a more hardened shaft 115.

Figure 5:
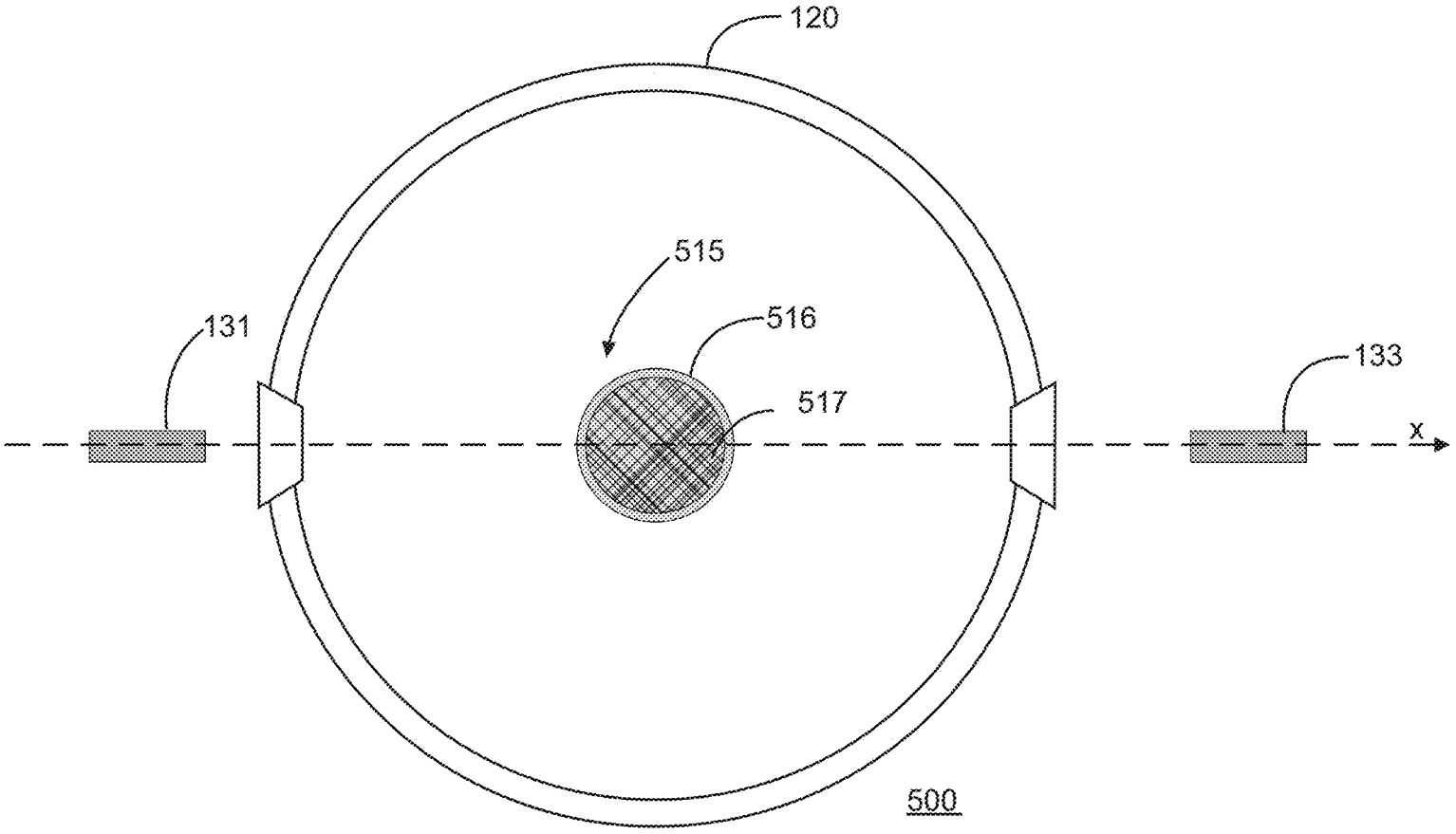
FIG. 5 is an exemplary sectional view of a system for hardening and compacting a spherical structure, according to an embodiment of the invention.

FIG. 5 is an exemplary sectional view of a system 500 for hardening and compacting a spherical structure 515, according to an embodiment of the invention. The system 500 shown in FIG. 2 is similar to the system 100 shown in FIG. 1A, and identical parts are numbered accordingly. Thus, as in FIG. 1A, 110 represents a confinement assembly, which includes a glass sorb 120 surrounding and contacting the spherical structure 515. According to this embodiment, the spherical structure 515 is polymer membrane or foil 516 filled with a powdered/granular material 517 for compaction. The pre-form powder material can also contain ceramic particles such as boron nitride, silica, alumina, and silicon carbide, and particles of cobalt and nickel. Particles of lower melting point alloys, such as aluminum and tin may be included to facilitate and preserve high hardness polymorphs formed during glass shock loading of a silicate pre-form. According to an embodiment of the invention, the powdered/granular material 517 may also include fiber materials. The spherical structure 515 may be used as an industrial part in a mechanical operation, for example, and thus may be sized in accordance with the application.

The hardening and compacting as outlined above with respect to the system 100 is also applicable to the system 500 of FIG. 5. Thus, in operation, the strikers 131 and 133, at speeds between 500 feet per second to about 20,000 feet per second, strike the glass orb 120. This generates explosive forces as outlined above. As outlined above, volume expansions due to Reynolds Dilatancy and the formation of failure waves, and also the creation of coesite or stishovite or seifertite and the accompanying volume change, within the confined space serves to pressurize the spherical structure 515, thereby hardening and compacting the spherical structure 215.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention. The invention including the stated variations is intended to be defined by the following claims and their equivalents, in which all terms are meant in their broadest reasonable sense unless otherwise indicated.

What is claimed is:

1. A system for hardening and compacting a spherical structure, the system comprising:

a confinement assembly comprising:

the spherical structure;

a glass orb surrounding and contacting the spherical structure; and a rigid outer shell encasing the glass orb and the spherical structure therewithin, wherein the spherical structure, the glass orb, and the rigid outer shell are positioned in a concentric relation with respect to each other;

a striker assembly comprising;

a first striker; and a second striker, wherein each of the first striker and the second striker is positioned to strike the confinement assembly from opposite sides of the confinement assembly along an axis that extends through a central region of the confinement assembly, so that when launched, the first and second striker shatter the glass of the glass orb to create an explosive volume expansion of the glass, which due to the confinement assembly results in compressive forces being applied to the surface of the spherical structure, thereby hardening and compacting the spherical structure.

2. The system for surface hardening and compacting a spherical structure of claim 1, further comprising a launching mechanism for each of the first striker and the second striker, launching and directing the striker assembly towards the confinement assembly at velocities between 500 feet per second to about 20,000 feet per second, so that upon impact, one or more of the following occurs:

a. multiple cracks form in the glass orb so that the volume occupied by glass in the glass orb increases as the cracks rupture and expand;

b. failure waves are propagated through the glass orb by each of the first striker and the second striker, the failure waves propagated from said opposite sides of the confinement assembly intersecting each other, wherein failure waves also reflect from the rigid outer shell, focusing the failure waves to form a failure wave interference system;

c. the glass orb develops at least one of coesite, stishovite, or seifertite which rupture and convert to an amorphous state through a volume change;

so that the occurrences of one or more of a, b, or c, creates said explosive volume expansion of the glass, which results in said compressive forces being applied to the spherical structure.

3. The system for surface hardening and compacting a spherical structure of claim 2, wherein the rigid outer shell has a first opening and a second opening for receiving the first striker and the second striker, respectively, therewithin.

4. The system for surface hardening and compacting a spherical structure of claim 3, wherein the first and second strikers each have a protrusion portion, wherein each of the protrusion portions has a stepped profile with two or more steps for impacting the glass orb.

5. The system for surface hardening and compacting a spherical structure of claim 4, wherein the spherical structure is a solid sphere.

6. The system for surface hardening and compacting a spherical structure of claim 3, wherein the spherical structure comprises a membrane or foil filled with powdered or granular ceramic materials.

7. The system for surface hardening and compacting a spherical structure of claim 6, wherein the first and second strikers each have a protrusion portion, wherein each of the protrusion portions has a rectangular profile with a flat head for impacting the glass orb.

8. A method of hardening and compacting a spherical structure, the method comprising:

providing a confinement assembly comprising:

the spherical structure;

a glass orb surrounding and contacting the spherical structure; and a rigid outer shell encasing the glass orb and the spherical structure therewithin, wherein the spherical structure, the glass orb, and the rigid outer shell are positioned in a concentric relation with respect to each other;

providing a striker assembly comprising:

a first striker; and a second striker, wherein each of the first striker and the second striker is positioned to strike the confinement assembly from opposite sides of the confinement assembly along an axis that extends through a central region of the confinement assembly; and directing each of the first striker and the second striker to strike the confinement assembly from opposite sides of the confinement assembly along an axis that extends through a central region of the confinement assembly, so that the first and second striker shatter the glass of the glass orb to create an explosive volume expansion of the glass, which due to the confinement assembly, results in compressive forces being applied to the surface of the spherical structure, thereby hardening and compacting the spherical structure.

9. The method of surface hardening and compacting of claim 8, wherein each of the first striker and the second striker is directed towards the confinement assembly at velocities between 500 feet per second to about 20,000 feet per second, so that upon impact, one or more of the following occurs:

a. multiple cracks form in the glass orb so that the volume occupied by glass in the glass orb increases as the cracks rupture and expand;

b. failure waves are propagated through the glass orb by each of the first striker and the second striker, the failure waves propagated from said opposite sides of the confinement assembly intersecting each other, wherein failure waves also reflect from the rigid outer shell, focusing the failure waves to form a failure wave interference system;

c. the glass orb develops at least one of coesite, stishovite, or seifertite which rupture and convert to an amorphous state through a volume change;

so that the occurrences of one or more of a, b, ore, creates said explosive volume expansion of the glass, which results in said compressive forces being applied to the surface of the spherical structure.

10. The method of surface hardening and compacting of claim 9, wherein the first and second strikers each have a protrusion portion, wherein each of the protrusion portions has a triangular profile with a pointed tip for impacting the glass orb or each of the protrusion portions had a stepped profile with two or more steps for impacting the glass orb.

11. The method of surface hardening and compacting of claim 10, wherein in the providing of the confinement assembly, the spherical structure is a solid sphere.

12. The method of surface hardening and compacting of claim 10, wherein in the providing of the confinement assembly, the spherical structure is a membrane or foil filled with powdered or granular ceramic materials.

* * * * *